US006797686B2

(12) United States Patent
Romero et al.

(10) Patent No.: US 6,797,686 B2
(45) Date of Patent: Sep. 28, 2004

(54) SOLID BODIES

(75) Inventors: Angelina Rena Romero, Tervuren (BE); Lionel Bernard Michel Genix, Brussels (BE); Christian Gossens, Kevelaer (DE)

(73) Assignee: The Procter & Gamble Company, Cincinnati, OH (US)

( * ) Notice: Subject to any disclaimer, the term of this patent is extended or adjusted under 35 U.S.C. 154(b) by 9 days.

(21) Appl. No.: 10/204,750

(22) PCT Filed: Feb. 28, 2001

(86) PCT No.: PCT/US01/06479

§ 371 (c)(1),
(2), (4) Date: Aug. 23, 2002

(87) PCT Pub. No.: WO01/64829

PCT Pub. Date: Sep. 7, 2001

(65) Prior Publication Data

US 2003/0092595 A1 May 15, 2003

(30) Foreign Application Priority Data

Mar. 1, 2000 (GB) ..... 0004805

(51) Int. Cl.[7] ..... C11D 17/00
(52) U.S. Cl. ..... 510/441; 510/446; 510/447
(58) Field of Search ..... 510/447, 441, 510/446

(56) References Cited

U.S. PATENT DOCUMENTS

| | | |
|---|---|---|
| 4,219,435 A | 8/1980 | Biard et al. |
| 5,916,866 A | 6/1999 | Davies et al. |

FOREIGN PATENT DOCUMENTS

| | | |
|---|---|---|
| GB | 983243 | 2/1965 |
| GB | 989638 | 4/1965 |
| GB | 1013686 | 12/1965 |
| WO | WO 93/00093 | 1/1993 |
| WO | WO 01/24779 A1 | 4/2001 |

OTHER PUBLICATIONS

A.J. DeSapio, Formulating Flexibility Using Microporous Entrapment Polymers, pp. 26,28, 29, 30, 32.

*Primary Examiner*—Yogendra N. Gupta
*Assistant Examiner*—John M Petruncio
(74) *Attorney, Agent, or Firm*—Julia A. Glazer; Brahm J. Corstanje; Kim W. Zerby

(57) ABSTRACT

Coated solid bodies comprising a core of an active composition and having a water-soluble or dispersible microporous or net-coating. The coating improves the mechanical characteristics of the solid body and allows for good dissolution. The coated solid bodies preferably take the form of detergent tablets.

19 Claims, No Drawings

SOLID BODIES

TECHNICAL FIELD

The present invention relates to coated solid bodies, in particular to coated solid bodies in the form of tablets, capsules, micro-tablets, powders, agglomerates and the like. In particular, it relates to coated solid bodies having improved dissolution characteristics together with excellent strength, surface hardness and storage stability. The invention also relates to a process for coating solid bodies, both water-soluble or dispersible bodies and other water-impermeable substrate. The coated solid bodies are suitable for a variety of uses including pharmaceuticals, detergents, food applications, etc. In the following, however, the invention will be primarily described in terms of detergent tablets.

BACKGROUND

Compositions in tablet form are well known in the art. Tablets hold several advantages over liquid and particulate composition forms, such as ease of dosing, handling, transportation and storage. Two main issues can still be improved in tablet formulation: dissolution rate and tablet strength. The most usual way to make tablets is by compression of particulate solids usually with a binder. However, a dichotomy exists in that as compression force is increased, the rate of dissolution of the tablets becomes slower. A low compression force, on the other hand, improves dissolution but at the expense of tablet strength. The presence of an external coating can enhance the tablet strength, allowing tabletting at a reduced compaction force which in turn enhances the speed of disintegration of a tablet. While tablets without a coating can be entirely effective in use, they usually lack the necessary surface hardness to withstand the abrasion that is a part of normal manufacture, packaging and handling. The result is that uncoated tablets can suffer from abrasion during these processes, resulting in chipped tablets and loss of active material. Also, especially in the case of highly alkaline compositions, the outer surface of an uncoated tablet may be aggressive to the skin and even somewhat hazardous to handle.

In such cases, tablet coating is highly desirable. Finally, coating of tablets is often desired for aesthetic reasons, to improve the outer appearance of the tablet or to achieve some particular aesthetic effect.

Numerous methods of tablet coating have been proposed for detergent tablets. GB-A-983,243 and GB-A-989,638 describe the use of a readily water-soluble organic film forming polymer as a coating material for detergent tablets to make the tablet resistant to abrasion and accidental breakage. The polymeric film is formed by spraying the tablet with an aqueous solution containing between 10 and 25% of polyalcohol and then drying with forced air, heated air or infra-red rays to harden the coating and evaporate the solvent.

GB-A-1,013,686 discloses a detergent tablet surrounded by a coating of an organic water-dispersible binder selected from of vinyl alcohol homopolymers and copolymers.

U.S. Pat. No. 5,916,866 describes tablets with a coating of a film-forming water-soluble organic polymer selected from the group consisting of polyethelene glycol, copolymers of vinyl pyrrolidone and vinyl acetate, and copolymers of maleate and acrylate.

U.S. Pat. No. 4,219,435 discloses a detergent tablet provided with a coating of a hydrated salt having a melting point in the range from 30° C. to 95° C., such coating being applied to the tablet in the form of a melt.

Polymer film-coatings as those described in the prior art usually exhibit good mechanical properties (i.e. strength and elasticity) but they have relatively poor dissolution characteristics in water. Film coatings can tend to slow down the dissolution rate of the tablet by opposing water penetration into the tablet core.

Hydrated salt coatings have a crystalline structure and present a very fast disintegration rate in contact with water. However, they are relatively weak and brittle due to their crystalline nature. Therefore, these coatings do not generally provide good tablet integrity.

As can be seen from the prior art, there is still a need to provide tablets having, at one and the same time, good dissolution rate, surface hardness, strength and integrity. One object of the present invention, therefore, is to provide coated tablets and other solid forms having good mechanical properties as well as having excellent dissolution and disintegration characteristics. Another object is to provide a method of coating solid bodies in order to provide improved protection for the body.

SUMMARY OF THE INVENTION

It has now been found that coating tablets and other water-soluble or water-dispersible solid forms with a water-soluble or dispersible micro-porous coating allows for excellent dissolution features at the same time as providing good mechanical strength and integrity. The coating structure is permeable to water, therefore water can penetrate rapidly into the core of the body and consequently the dissolution process is not delayed by the presence of the coating.

According to one aspect of the present invention, there is provided a coated solid body comprising a core of an active composition and having a water-soluble or dispersible micro-porous coating. The term "micro-porous" herein indicates that the coating is permeable to water under ambient conditions and comprises pores or interstices (hereinafter referred to as pores) of generally microscopic size. In general terms, the pores have an average pore diameter in the range from about 1 to about 500 $\mu$m, preferably from about 5 to about 200 $\mu$m and more preferably from about 10 to about 100 $\mu$m.

In highly preferred embodiments, the solid body is coated with a network of fibres, the meshes of which define the pores of the coating. Thus according to another aspect of the invention, there is provided a coated solid body comprising a core of an active composition and having a porous water-soluble or dispersible fibre network coating (sometimes referred to herein as a "net-coating"). Preferably, the net-coating has an average mesh size in the range from about 1 to about 500 $\mu$m, preferably from about 5 to about 200 $\mu$m and more preferably from about 10 to about 100 $\mu$m. The terms poro size and mesh size are used interchangeably herein and expressed as the square root of the cross-sectional area of the pore or mesh in the plane of the coating.

The micro-porous or net coating structure is formed from a concentrated solution of polymers sprayed onto the body, generally under conditions which lead to fast evaporation of the solvent. The precise nature of the coating including the size of the pores depends on the nature of the solvent, on the chemistry of the polymers, the concentration of the polymeric solutions and on the process conditions, especially the drying conditions.

The micro-porous or net coating is preferably formed from a solution comprising a water-soluble or dispersible polymer. Suitable polymers for use herein include polyvinyl alcohols, polyvinylpyrrolidones, polyvinyl acetates and partially hydrolysed polyvinyl acetates, polyvinyl amides, biopolymers and biopolymeric polyelectrolytes including carrageenans, pectins, gelatin, xanthan, alginates, agar, starch, latex, polymers derived from cellulose such as microcrystalline cellulose, methyl cellulose, ethyl cellulose, hydroxypropyl cellulose, carboxymethyl cellulose and mixtures thereof. Preferred polymers for use herein are thermoplastic polymers.

The coating solution preferred for use herein is a concentrated water-soluble or water-dispersable polymer solution, containing the polymer in a proportion of from about 15% to about 70%, more preferably from about 20% to about 60% and most preferably from about 25% to about 50% by weight thereof.

The polymer solution will normally comprise from about 30% to about 85% preferably from about 40% to about 80% and more preferable from about 50% to about 75% of solvent selected from organic and aqueous solvents and mixtures thereof. Organic solvents may require complex drying steps, in addition to health, safety and environmental considerations, therefore aqueous solutions are preferred for use herein. The polymer solution is highly concentrated, therefore it does not require prolonged heating to remove excess water.

Another important factor for optimum coating performance is the rheology of the polymer solution. The solution herein used should behave as non-Newtonian when subject to stress, its behaviour being described by the Herschel-Bulkey model according to the following equation:

$$\tau=\tau_y K \gamma^n$$

where $\tau$ is the shear stress (Pa), $\tau_y$ is the yield stress (Pa), K is the fluid consistency index (Pa $s^n$), n is the power law exponent and $\gamma$ is the shear rate ($s^{-1}$). Preferred for use herein are polymer solutions having a consistency index from about 1.0 to about 50 and preferably from about 4 to about 30, a power law exponent from about 0.1 to about 1.0 and preferably from about 0.4 to about 0.9 and a yield stress from about 0 to about 1.0 and preferably from about 0 to about 0.8. Highly preferred are polymer solutions characterised by a non-zero yield stress and a shear stress of at least 20 Pa, preferably at least 30 Pa at a shear rate of 10 $s^{-1}$.

All rheological measurements are carried out using a Carrimed Cs12 100 with a 40 mm stainless steel parallel plate. The polymer solutions are equilibrated for 24 hours at room temperature prior to measurement. Samples are measured at room temperature (25° C.) with no mixing before sampling.

In order to promote the dissolution of the coated solid body, a disintegrant can be included in the core and/or in the coating. The disintegrant will swell once in contact with water, helping to break the solid body and/or the coating. Suitable disintegrants are described in Handbook of Pharmaceutical Excipients (1986) and include water-insoluble polymeric disintegrants as well as cation exchange resins as described below. Examples of suitable disintegrants include starch: natural, modified or pregelatinized starch, sodium starch gluconate; gum: agar gum, guar gum, locust bean gum, karaya gum, pectin gum, tragacanth gum; croscarmylose Sodium, crospovidone, cellulose, algenic acid and its salts including sodium alginate, silicon dioxide, clay, ion exchange resins, polymers containing cationic (e.g. quaternary ammonium) groups, amine-substituted polyacrylates, polymerised cationic amino acids such as poly-L-lysine, polyallylamine hydrochloride and mixtures thereof.

The dissolution performance of the coated solid body can be further enhanced by effervescent agents or highly soluble components. Suitable effervescent agents for use herein include perborate, percarbonate, carbonate and bicarbonate in combination with an inorganic acid such as sulphamic acid or a carboxylic acid such as citric or maleic acid. Preferred herein is a (bi)carbonate/acid effervescent system.

In another embodiment of the invention the coated solid body comprises an auxiliary continuous coating. The auxiliary continuous coating preferably comprises a substantially insoluble dicarboxylic acid and optionally comprises a component which is liquid at 25° C. and a disintegrant. The auxiliary continuous coating can be applied on top of the micro-porous or net-coating or in between the core and the micro-porous or net-coating in order, for example, to provide aesthetic effects or controlled dissolution characteristics.

The average thickness of the micro-porous or net-coating is generally from about 1 to about 500 $\mu$m and most preferably from about 5 to about 200 $\mu$m. Moreover, the coating can extend to cover either a part or the whole of the core as appropriate. Preferably, however, it will extend across at least about 40%, more preferably at least about 70% and especially 100% of the surface of the core. The coating is generally in the range from about 0.1 to about 5%, preferably from about 0.2 to about 2% by weight of the solid body.

In preferred embodiments of the invention the solid body is in the form of a single or multi-phase detergent tablet, i.e., detergent tablets having a single or multi-phase tablet core. Multi-phases tablets include tablets having multiple layers as well as tablets having a depression or mould in the main body of the tablet and a compressed or non-compressed portion contained within the depression or mould. In such embodiments, the multi-phase tablet can comprises a partial coating which extends across one or more phases of the core so as to provide differential dissolution or release of the active components of the core.

In preferred embodiments of the invention, the coating of the solid body (which term includes bodies of a semi-solid or viscous fluid or gel-like nature) is produced according to a process comprising the step of contacting the body with a solution of a polymer. The concentration and Theological characteristic of the polymer solution, as described hereinabove, are such as to generate elongated and viscoplastic fibre-forming droplets. These fibre-forming droplets are partially dried prior to contacting the body and the formed coating is dried thereafter. In a preferred aspect the fibre-forming droplets are formed by spraying through one or more spray nozzles situated at a distance from about 10 to about 30 cm proximal distance from the surface of the solid body, the fibre-forming droplets being partially dried prior to contacting the solid body, for example in a current of hot air.

One objective of the present invention is to provide coated detergent tablets and other water-soluble or dispersible solid bodies with excellent dissolution/dispersion characteristics as well as excellent mechanical properties. This is achieved by coating the solid body with a water-soluble or dispersible micro-porous or net-coating. The composition of the invention preferably takes the form of a single or multi-phase detergent tablet and can include one or more active and auxiliary components of detergent tablets as described in detail below.

Auxiliary Coating Materials

The compositions herein can include an auxiliary coating situated either on top of the micro-porous or net-coating or in between the core and the micro-porous or net-coating. The auxiliary coating generally has a crystalline structure. By crystalline, it should be understood that the coating comprises a material which is solid at ambient temperature (25° C.) and has a structure exhibiting some order. This can be detected typically by usual crystallography techniques e.g. X-ray analysis, on the material itself. Preferably, the material forming the crystalline structure does not co-crystallised or only partially with the optional component which is liquid at 25° C. mentioned above. Indeed, it is preferred that the optional component remains in the liquid state at 25° C. in the coating crystalline structure in order to provide flexibility to the structure and resistance to mechanical stress. The optional component which is liquid at 25° C. may advantageously have a functionality in the washing of laundry, for example silicone oil which provides suds suppression benefits or perfume oil. In preferred embodiments of the invention the crystalline auxiliary coating contains a disintegrant.

Preferred coating ingredients are for example dicarboxylic acids. Particularly suitable dicarboxylic acids are selected from the group consisting of oxalic acid, malonic acid, succinic acid, glutaric acid, adipic acid, pimelic acid, suberic acid, azelaic acid, sebacic acid, undecanedioic acid, dodecanedioic acid, tridecanedioic acid and mixtures thereof. Most preferred is adipic acid.

Typically, substantially insoluble materials having a melting point below 40° C. are not sufficiently solid at ambient temperatures and it has been found that materials having a melting point above about 200° C. are less practicable to use. Preferably, an acid having a melting point of more than 90° C. such as azelaic, sebacic acid, dodecanedioic acid is used. An acid having a melting point of more than 145° C. such as adipic is particularly suitable.

By "melting point" is meant the temperature at which the material when heated slowly in, for example, a capillary tube becomes a clear liquid.

An auxiliary coating of any desired thickness can be applied. For most purposes, the coating forms from 1% to 10%, preferably from 1.5% to 5%, of the tablet weight. Tablet coatings are very hard and provide extra strength to the tablet.

Examples of optional components which are liquid at 25° are including PolyEthylene Glycols, thermal oil, silicon oil, esters of dicarboxylic acids, mono carboxylic acids, parafin, triacetin, perfumes or alkaline solutions. It is preferred that the structure of the components which is liquid at 25° C. is close to the material forming the crystallised structure, so that the structure is not excessively disrupted. More preferably, the crystallised structure is made of adipic acid, the component which is liquid at 25° C. being available under the name Coasol™ from Chemoxy International, being a blend of the di-isobutyl esters of the glutaric, succinic and adipic acid. The advantage of the use of this component being the good dispersion in the adipic acid to provide flexibility. It should be noted that disintegration of the adipic acid is further improved by the adipate content of Coasol™. Fracture of the coating in the wash can be improved by adding a disintegrant in the coating.

A preferred auxiliary coating comprise an ion exchange resin as disintegrant, preferably a cation exchange resin. They can be strong acid cation resins, weak acid cation resins or mixed functionality resins. Each kind is briefly described and examples of commercially available cation exchange resins are given herein below.

Strong acid cation exchange resins are generally composed of an insoluble poly(styrene-divinylbenzene) co-polymer which has been functionalised with sulfonic acid groups. The sulfonic acid groups may be present in the acid form or as a salt with a metal counterion. Many examples of these materials are commercially available; typical examples, sold by Rohm & Haas, are: Amberlite® IR-120 (plus), Amberlite® IR-120(plus) sodium form and Amberlite® IRP-69. Other examples, available from Dow Chemical, are Dowex® 50WX8-100, Dowex® HCR-W2. Other examples can be prepared to show optimal performance in the application by varying several chemical aspects of the resin such as degree of sulfonation, level of crosslinking, type of counterion, or the nature of any other monomers included in the polymerisation step, as well as physical parameters such as particle size and moisture.

Weak acid cation exchange resins are generally composed of co-polymers of a suitable alkenyl carboxylic acid (e.g. acrylic acid or methacrylic acid) with divinylbenzene. The carboxylic groups may be present in the acid form or as a salt with a metal counterion. Many examples of these materials are commercially available; typical examples, are: Amberlite® IRP-64 (Rohm & Haas), Dowex® CCR-3(plus) (Dow Chemical). Other examples can be prepared to show optimal performance in the application by varying several chemical aspects of the resin such as the level and type of monomers included in the polymerisation step, the level of crosslinking or the type of counterion.

Occasionally, cation exchange resins may contain both weak acid and strong acid functionality. These cannot be easily categorised into the above but are within the scope of the invention.

The strong acid cation exchange resins in alkali metal or alkaline earth metal salt form are found to be the most effective resins for the tablet coating application described.

For most applications, ion exchange resins are employed as beads of particle size of more than 300 micron. However, in certain applications it is preferred to use material of a lower particle size. Particle size reduction is typically carried out using suitable milling equipment, as described in EP 837110 (Rohm & Haas). For the purposes of the invention, the resin is preferably ground to a mean particle size of less than 200 micron. More preferably it will be ground to have a particle size of less than 100 micron. In certain cases, resins may be prepared in specialised conditions to produce particles in the preferred particle size without the need for grinding.

The moisture level of resins can be determined by procedures described in *Kirk-Othmer's Encyclopedia of Chemical Technology*, $4^{th}$ Edition, Volume 14, pp 755–756. For the purposes of the invention, the resin will be dried using conventional techniques to obtain a moisture level of preferably less than 25%. More preferably, the moisture level will be less than 12%.

Examples of commercially available cation exchange resins which have both small particle size (less than 150 micron) and low moisture level (less than 12%) are sold by Purolite under the names Purolite® C100NaMR, a sodium salt sulfonated poly(styene-divinylbenzene) co-polymer and Purolite® C100CaMR, a calcium salt sulfonated poly (styene-divinylbenzene) co-polymer. These are produced for use in the pharmaceutical industry for the treatment of blood disorders but also make effective tablet coating disintegrants according to the present invention.

Highly Soluble Compounds

The compositions herein can comprise a highly soluble compound. Such a compound could be formed from a mixture or from a single compound. A highly soluble compound is defined as follow:

A solution is prepared as follows comprising de-ionised water as well as 20 grams per liter of a specific compound:

1—20 g of the specific compound is placed in a Sotax Beaker. This beaker is placed in a constant temperature bath set at 10° C. A stirrer with a marine propeller is placed in the beaker so that the bottom of the stirrer is at 5 mm above the bottom of the Sotax beaker. The mixer is set at a rotation speed of 200 turn per minute.

2—980 g of the de-ionised water is introduced into the Sotax beaker.

3—10 s after the water introduction, the conductivity of the solution is measured, using a conductivity meter.

4—Step 3 is repeated after 20, 30, 40, 50, 1 min, 2 min, 5 min and 10 min after step 2.

5—The measurement taken at 10 min is used as the plateau value or maximum value.

The specific compound is highly soluble according to the invention when the conductivity of the solution reaches 80% of its maximum value in less than 10 seconds, starting from the complete addition of the de-ionised water to the compound. Indeed, when monitoring the conductivity in such a manner, the conductivity reaches a plateau after a certain period of time, this plateau being considered as the maximum value. Such a compound is preferably in the form of a flowable material constituted of solid particles at temperatures comprised between 10 and 80° Celsius for ease of handling, but other forms may be used such as a paste or a liquid.

Example of highly soluble compounds include sodium di isobutylbenzene sulphonate (DIBS), sodium toluene sulphonate, sodium acetate, ammonium acetate, calcium acetate, potassium acetate, rubidium acetate, urea and mixtures thereof.

Cohesive Effect

The tablet may comprise a compound having a cohesive effect on the particulate material of a detergent matrix forming the tablet. The cohesive effect on the particulate material of a detergent matrix forming the tablet or a layer of the tablet is characterised by the force required to break a tablet or layer based on the examined detergent matrix pressed under controlled compression conditions. For a given compression force, a high tablet or layer strength indicates that the granules stuck highly together when they were compressed, so that a strong cohesive effect is taking place. Means to assess tablet or layer strength (also refer to diametrical fracture stress) are given in Pharmaceutical dosage forms: tablets volume 1 Ed. H. A. Lieberman et al, published in 1989.

The cohesive effect is measured by comparing the tablet or layer strength of the original base powder without compound having a cohesive effect with the tablet or layer strength of a powder mix which comprises 97 parts of the original base powder and 3 parts of the compound having a cohesive effect. The compound having a cohesive effect is preferably added to the matrix in a form in which it is substantially free of water (water content below 10% (pref below 5%)). The temperature of the addition is between 10° and 80° C., more pref. between 10° and 40° C.

A compound is defined as having a cohesive effect on the particulate material according to the invention when at a given compacting force of 3000N, tablets with a weight of 50 g of detergent particulate material and a diameter of 55 mm have their tablet tensile strength increased by over 30% (preferably 60 and more preferably 100%) by means of the presence of 3% of the compound having a cohesive effect in the base particulate material. An example of a compound having a cohesive effect is Sodium di isoalkylbenzene sulphonate.

When integrating a highly soluble compound having also a cohesive effect on the particulate material used for a tablet or layer formed by compressing a particulate material comprising a surfactant, the dissolution of the tablet or layer in an aqueous solution is significantly increased.

It should be noted that a composition comprising a highly soluble compound as well as a surfactant is disclosed in EP-A-0 524 075, this composition being a liquid composition. A highly soluble compound having a cohesive effect on the particulate material allows to obtain a tablet having a higher tensile strength at constant compacting force or an equal tensile strength at lower compacting force when compared to traditional tablets. Typically, a whole tablet will have a tensile strength of more than 5 kPa, preferably of more than 10 kPa, more preferably, in particular for use in laundry applications, of more than 15 kPa, even more preferably of more than 30 kPa and most preferably of more than 50 kPa, in particular for use in dish washing or auto dish washing applications; and a tensile strength of less than 300 kPa, preferably of less than 200 kPa, more preferably of less than 100 kPa, even more preferably of less than 80 kPa and most preferably of less than 60 kPa. Indeed, in case of laundry application, the tablets should be less compressed than in case of auto dish washing applications for example, whereby the dissolution is more readily achieved, so that in a laundry application, the tensile strength is preferably of less than 30 kPa.

This allows to produce tablets or layers which have a solidity and mechanical resistance comparable to the solidity or mechanical resistance of traditional tablets while having a less compact tablet or layer thus dissolving more readily. Furthermore, as the compound is highly soluble, the dissolution of the tablet or layer is further facilitated, resulting in a synergy leading to facilitated dissolution for a tablet according to the invention.

Tablet Manufacture

The tablet may comprise several layers. For the purpose of manufacture of a single layer, the layer may be considered as a tablet itself.

Detergent tablets can be prepared simply by mixing the solid ingredients together and compressing the mixture in a conventional tablet press as used, for example, in the pharmaceutical industry. Preferably the principal ingredients, in particular gelling surfactants, are used in particulate form. Any liquid ingredients, for example surfactant or suds suppressor, can be incorporated in a conventional manner into the solid particulate ingredients.

In particular for laundry tablets, the ingredients such as builder and surfactant can be spray-dried in a conventional manner and then compacted at a suitable pressure. Preferably, the tablets according to the invention are compressed using a force of less than 100000N, more preferably of less than 50000N, even more preferably of less than 5000N and most preferably of less than 3000 N. Indeed, the most preferred embodiment is a tablet suitable for laundry compressed using a force of less than 2500N, but tablets for auto dish washing may also be considered for example, whereby such auto dish washing tablets are usually more compressed than laundry tablets.

The particulate material used for making a tablet can be made by any particulation or granulation process. An example of such a process is spray drying (in a co-current or counter current spray drying tower) which typically gives low bulk densities 600 g/l or lower. Particulate materials of higher density can be prepared by granulation and densification in a high shear batch mixer/granulator or by a continuous granulation and densification process (e.g. using Lodige® CB and/or Lodige® KM mixers). Other suitable processes include fluid bed processes, compaction processes (e.g. roll compaction), extrusion, as well as any particulate material made by any chemical process like flocculation, crystallisation sentering, etc. Individual particles can also be any other particle, granule, sphere or grain.

The components of the particulate material may be mixed together by any conventional means. Batch is suitable in, for example, a concrete mixer, Nauta mixer, ribbon mixer or any other. Alternatively the mixing process may be carried out continuously by metering each component by weight on to a moving belt, and blending them in one or more drum(s) or mixer(s). Non-gelling binder can be sprayed on to the mix of some, or all of, the components of the particulate material. Other liquid ingredients may also be sprayed on to the mix of components either separately or premixed. For example perfume and slurries of optical brighteners may be sprayed. A finely divided flow aid (dusting agent such as zeolites, carbonates, silicas) can be added to the particulate material after spraying the binder, preferably towards the end of the process, to make the mix less sticky.

The tablets may be manufactured by using any compacting process, such as tabletting, briquetting, or extrusion, preferably tabletting. Suitable equipment includes a standard single stroke or a rotary press (such as Courtoy®, Korch®, Manesty®, or Bonals®). The tablets prepared according to this invention preferably have a diameter of between 20 mm and 60 mm, preferably of at least 35 and up to 55 mm, and a weight between 25 and 100 g. The ratio of height to diameter (or width) of the tablets is preferably greater than 1:3, more preferably greater than 1:2. The compaction pressure used for preparing these tablets need not exceed 100000 $kN/m^2$, preferably not exceed 30000 $kN/m^2$, more preferably not exceed 5000 $kN/m^2$, even more preferably not exceed 3000 $kN/m^2$ and most preferably not exceed 1000 $kN/m^2$. Tablets usually have a density of at least 0.9 $g/cm^3$, more preferably of at least 1.0 $g/cm^3$, and preferably of less than 2.0 $g/cm^3$, more preferably of less than 1.5 $g/cm^3$, even more preferably of less than 1.25 $g/cm^3$ and most preferably of less than 1.1 $g/cm^3$.

Multi layered tablets are typically formed in rotating presses by placing the matrices of each layer, one after the other in matrix force feeding flasks. As the process continues, the matrix layers are then pressed together in the pre-compression and compression stages stations to form the multilayer layer tablet. With some rotating presses it is also possible to compress the first feed layer before compressing the whole tablet.

Hydrotrope Compound

A highly soluble compound having a cohesive effect may be integrated to a detergent tablet, whereby this compound is also a hydrotrope compound. Such hydrotrope compound may be generally used to favour surfactant dissolution by avoiding gelling. A specific compound is defined as being hydrotrope as follows (see S. E. Friberg and M. Chiu, J. Dispersion Science and Technology, 9(5&6), pages 443 to 457, (1988–1989)):

1. A solution is prepared comprising 25% by weight of the specific compound and 75% by weight of water.

2. Octanoic Acid is thereafter added to the solution in a proportion of 1.6 times the weight of the specific compound in solution, the solution being at a temperature of 20° Celsius. The solution is mixed in a Sotax beaker with a stirrer with a marine propeller, the propeller being situated at about 5 mm above the bottom of the beaker, the mixer being set at a rotation speed of 200 rounds per minute.

3. The specific compound is hydrotrope if the the Octanoic Acid is completely solubilised, i.e. if the solution comprises only one phase, the phase being a liquid phase. The hydrotrope compound is preferably a flowable material made of solid particles at operating conditions between 15 and 60° Celsius.

Hydrotrope compounds include the compounds listed thereafter:

A list of commercial hydrotropes could be found in McCutcheon's Emulsifiers and Detergents published by the McCutcheon division of Manufacturing Confectioners Company. Compounds of interest also include:

1. Nonionic hydrotrope with the following structure:

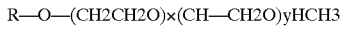

where R is a C8–C10 alkyl chain, x ranges from 1 to 15, y from 3 to 10.

2. Anionic hydrotropes such as alkali metal aryl sulfonates. This includes alkali metal salts of benzoic acid, salicylic acid, bezenesulfonic acid and its many derivatives, naphthoic acid and various hydroaromatic acids. Examples of these are sodium, potassium and ammonium benzene sulfonate salts derived from toluene sulfonic acid, xylene sulfonic acid, cumene sulfonic acid, tetralin sulfonic acid, naphtalene sulfonic acid, methyl-naphtalene sulfonic acid, dimethyl naphtalene sulfonic acid and trimethyl naphtalene sulfonic acid.

Other examples include salts of dialkyl benzene sulfonic acid such as salts of di-isopropyl benzene sulfonic acid, ethyl methyl benzene sulfonic acid, alkyl benzene sulfonic acid with an alkyl chain length with 3 to 10, (pref 4 to 9), linear or branched alkyl sulfonates with an alkyl chain with 1 to 18 carbons.

3. Solvent hydrotropes such as alkoxylated glycerines and alkoxylated glycerides, esters slakoxylated glycerines, alkoxylated fatty acids, esters of glycerin, polyglycerol esters. Preferred alkoxylated glycerines have the following structure:

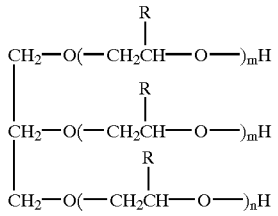

where 1, m and n are each a number from 0 to about 20, with 1+m+n=from about 2 to about 60, preferably from about 10 to about 45 and R represents H, $CH_3$ or $C_2H_5$ Preferred alkoxylated glycerides have the following structure

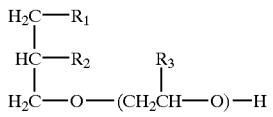

where R1 and R2 are each $C_nCOO$ or —(CH2CHR$_3$—O)$_1$—H where $R_3$=H, $CH_3$ or $C_2H_5$ and 1 is a number from 1 to about 60, n is a number from about 6 to about 24.

4. Polymeric hydrotropes such as those described in EP636687:

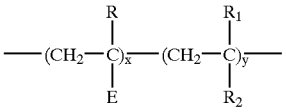

where E is a hydrophilic functional group,

R is H or a C1–C10 alkyl group or is a hydrophilic functional group;

R1 is H a lower alkyl group or an aromatic group,

R2 is H or a cyclic alkyl or aromatic group.

The polymer typically has a molecular weight of between about 1000 and 1000000.

5. Hydrotrope of unusual structure such as 5-carboxy-4-hexyl-2-cyclohexene-1-yl octanoic acid (Diacid®)

Use of such compound in the invention would further increase the dissolution rate of the tablet, as a hydrotrope compound facilitates dissolution of surfactants, for example. Such a compound could be formed from a mixture or from a single compound.

Tensile Strength

For the purpose of measuring tensile strength of a layer, the layer may be considered as a tablet itself.

Depending on the composition of the starting material, and the shape of the tablets, the used compacting force may be adjusted to not affect the tensile strength, and the disintegration time in the washing or dishwashing machine. This process may be used to prepare homogenous or layered tablets of any size or shape.

For a cylindrical tablet, the tensile strength corresponds to the diametrical fracture stress (DFS) which is a way to express the strength of a tablet or layer, and is determined by the following equation:

$$\textit{Tensile strength}=2F/\pi Dt$$

Where F is the maximum force (Newton) to cause tensile failure (fracture) measured by a VK 200 tablet hardness tester supplied by Van Kell industries, Inc. D is the diameter of the tablet or layer, and t the thickness of the tablet or layer. For a non round tablet, πD may simply be replaced by the perimeter of the tablet.

(Method Pharmaceutical Dosage Forms: Tablets Volume 2 Page 213 to 217) A tablet having a diametral fracture stress of less than 20 kPa is considered to be fragile and is likely to result in some broken tablets being delivered to the consumer. A diametral fracture stress of at least 25 kPa is preferred.

This applies similarly to non cylindrical tablets, to define the tensile strength, whereby the cross section normal to the height of the tablet is non round, and whereby the force is applied along a direction perpendicular to the direction of the height of the tablet and normal to the side of the tablet, the side being perpendicular to the non round cross section.

Tablet Dispensing

The rate of dispensing of a detergent tablet can be determined in the following way:

Two tablets, nominally 50 grams each, are weighed, and then placed in the dispenser of a Baucknecht® WA9850 washing machine. The water supply to the washing machine is set to a temperature of 20° C. and a hardness of 21 grains per gallon, the dispenser water inlet flow-rate being set to 8 l/min. The level of tablet residues left in the dispenser is checked by switching the washing on and the wash cycle set to wash program 4 (white/colors, short cycle). The dispensing percentage residue is determined as follows: % dispensing=residue weight×100/*original tablet weight*

The level of residues is determined by repeating the procedure 10 times and an average residue level is calculated based on the ten individual measurements. In this stressed test a residue of 40% of the starting tablet weight is considered to be acceptable. A residue of less than 30% is preferred, and less than 25% is more preferred.

It should be noted that the measure of water hardness is given in the traditional "grain per gallon" unit, whereby 0.001 mole per liter=7.0 grain per gallon, representing the concentration of $Ca^{2+}$ ions in solution.

Effervescent Agent

Detergent tablets may further comprise an effervescent agent.

Effervescency as defined herein means the evolution of bubbles of gas from a liquid, as the result of a chemical reaction between a soluble acid source and an alkali metal carbonate, to produce carbon dioxide gas, $$C_6H_8O_7+3NaHCO_3 \rightarrow Na_3C_6H_5O_7+3CO_2\uparrow+3H_2O \quad \text{i.e.}$$

Further examples of acid and carbonate sources and other effervescent systems may be found in: (Pharmaceutical Dosage Forms: Tablets Volume 1 Page 287 to 291).

An effervescent agent may be added to the tablet mix in addition to the detergent ingredients. The addition of this effervescent agent to the detergent tablet improves the disintegration time of the tablet. Preferably the effervescent agent should be added as an agglomerate of the different particles or as a compact, and not as separated particles. Due to the gas created by the effervescency in the tablet, the tablet can have a higher D.F.S. and still have the same disintegration time as a tablet without effervescency. When the D.F.S. of the tablet with effervescency is kept the same as a tablet without, the disintegration of the tablet with effervescency will be faster.

Further dissolution aid could be provided by using compounds such as sodium acetate or urea. A list of suitable dissolution aid may also be found in Pharmaceutical Dosage Forms: Tablets, Volume 1, Second edition, Edited by H. A. Lieberman et all, ISBN 0-8247-8044-2.

Detersive Surfactants

Surfactant are typically comprised in a detergent composition. The dissolution of surfactants is favoured by the addition of the highly soluble compound.

Nonlimiting examples of surfactants useful herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)\times(CHOSO_3—M^+)$ $CH_3$ and $CH_3(CH_2)_y(CHOSO_3—M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Non Gelling Binders

Non gelling binders can be integrated in detergent compositions to further facilitate dissolution.

If non gelling binders are used, suitable non-gelling binders include synthetic organic polymers such as polyethylene glycols, polyvinylpyrrolidones, polyacrylates and water-soluble acrylate copolymers. The handbook of Pharmaceutical Excipients second edition, has the following binders classification: Acacia, Alginic Acid, Carbomer, Carboxymethylcellulose sodium, Dextrin, Ethylcellulose, Gelatin, Guar gum, Hydrogenated vegetable oil type I, Hydroxyethyl cellulose, Hydroxypropyl methylcellulose, Liquid glucose, Magnesium aluminum silicate, Maltodextrin, Methylcellulose, polymethacrylates, povidone, sodium alginate, starch and zein. Most preferable binders also have an active cleaning function in the laundry wash such as cationic polymers, i.e. ethoxylated hexamethylene diamine quaternary compounds, bishexamethylene triamines, or others such as pentaamines, ethoxylated polyethylene amines, maleic acrylic polymers.

Non-gelling binder materials are preferably sprayed on and hence have an appropriate melting point temperature below 90° C., preferably below 70° C. and even more preferably below 50° C. so as not to damage or degrade the other active ingredients in the matrix. Most preferred are non-aqueous liquid binders (i.e. not in aqueous solution) which may be sprayed in molten form. However, they may also be solid binders incorporated into the matrix by dry addition but which have binding properties within the tablet.

It is preferred that gelling binders, such as nonionic surfactants are avoided in their liquid or molten form. Nonionic surfactants and other gelling binders are not excluded from the compositions, but it is preferred that they be processed into the detergent tablets as components of particulate materials, and not as liquids.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition. Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite of layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}\cdot yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973. Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y]\cdot xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}]\cdot xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Bleach

The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

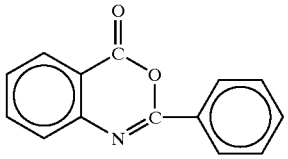

Still another class of preferred bleach activators includes the acyl lactam activators, especially acyl caprolactams and acyl valerolactam of the formulae:

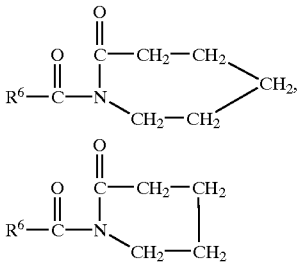

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalo-cyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. Nos. 5,246,621, 5,244,594; 5,194,416; 5,114,606; and European Pat. App. Pub. Nos. 549,271A1, 549,272A1, 544,440A2, and 544,490A1; Preferred examples of these catalysts include $Mn^{IV}{}_2(u\text{-}O)_3$(1,4,7-trimethyl-1,4,7-triazacyclononane)$_2(PF_6)_2$, $Mn^{III}{}_2(u\text{-}O)_1(u\text{-}OAc)_2$(1,4,7-trimethyl-1,4,7-triazacyclononane)$_2$–$(ClO_4)_2$, $Mn^{IV}{}_4(u\text{-}O)_6$(1,4,7-triazacyclononane)$_4(ClO_4)_4$, $Mn^{III}Mn^{IV}{}_4(u\text{-}O)_1(u\text{-}OAc)_2$-(1,4,7-trimethyl- 1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. Nos. 4,430,243 and 5,114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Enzymes

Enzymes can be included in the formulations herein for a wide variety of dish or fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985). Amylases include, for example, α-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the Pseudomonas group, such as Pseudomonas stutzeri ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex Pseudomonas gladioli. The LIPOLASE enzyme derived from Humicola lanuginosa and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Other components which are commonly used in detergent compositions and which may be incorporated into detergent tablets include chelating agents, soil release agents, soil antiredeposition agents, dispersing agents, suds suppressors, fabric softeners, dye transfer inhibition agents and perfumes.

The compounds disclosed above for a product are advantageously packed in a packaging system.

A packaging system may be formed from a sheet of flexible material. Materials suitable for use as a flexible sheet include mono-layer, co-extruded or laminated films. Such films may comprise various components, such as poly-ethylene, poly-propylene, poly-styrene, poly-ethylene-terephtalate. Preferably, the packaging system is composed of a poly-ethylene and bi-oriented-poly-propylene co-extruded film with an MVTR of less than 5 g/day/$m^2$. The MVTR of the packaging system is preferably of less than 10 g/day/$m^2$, more preferably of less than 5 g/day/$m^2$. The film (2) may have various thicknesses. The thickness should typically be between 10 and 150 $\mu$m, preferably between 15 and 120 $\mu$m, more preferably between 20 and 100 $\mu$m, even more preferably between 25 and 80 $\mu$m and most preferably between 30 and 40 $\mu$m.

A packaging material preferably comprises a barrier layer typically found with packaging materials having a low oxygen transmission rate, typically of less than 300 $cm^3/m^2$/day, preferably of less than 150 $cm^3/m^2$/day, more preferably of less than 100 $cm^3/m^2$/day, even more preferably of less than 50 $cm^3/m^2$/day and most preferably of less than 10 $cm^3/m^2$/day. Typical materials having such barrier properties include bi oriented polypropylene, poly ethylene terephthalate, Nylon, poly(ethylene vinyl alcohol), or laminated materials comprising one of these, as well as SiOx (Silicium oxydes), or metallic foils such as aluminium foils for example. Such packaging material may have a beneficial influence on the stability of the product during storage for example.

Among the packing method used are typically the wrapping methods disclosed in WO92/20593, including flow wrapping or over wrapping. When using such processes, a longitudinal seal is provided, which may be a fin seal or an overlapping seal, after which a first end of the packaging system is closed with a first end seal, followed by closure of the second end with a second end seal. The packaging system may comprise re-closing means as described in WO92/20593. In particular, using a twist, a cold seal or an adhesive is particularly suited. Indeed, a band of cold seal or a band of adhesive may be applied to the surface of the packaging system at a position adjacent to the second end of the packaging system, so that this band may provide both the initial seal and re-closure of the packaging system. In such a case the adhesive or cold seal band may correspond to a region having a cohesive surface, i.e. a surface which will adhere only to another cohesive surface. Such re-closing means may also comprise spacers which will prevent unwanted adhesion. Such spacers are described in WO 95/13225, published on the May 18$^{th}$ 1995. There may also be a plurality of spacers and a plurality of strips of adhesive material. The main requirement is that the communication between the exterior and the interior of the package should be minimal, even after first opening of the packaging system. A cold seal may be used, and in particular a grid of cold seal, whereby the cold seal is adapted so as to facilitate opening of the packaging system.

EXAMPLES

The following composition was prepared by mixing the dry-added materials followed by spraying on of the perfume and binder.

| Composition<br>Dry adds | T<br>% Composition |
|---|---|
| Anionic surfactant agglomerate A | 9.79 |
| Anionic surfactant agglomerate B | 22.3 |
| Nonionic surfactant agglomerate | 9.13 |
| Cationic surfactant agglomerate | 4.67 |

-continued

| Composition<br>Dry adds | T<br>% Composition |
|---|---|
| Bleach activator agglomerate | 6.09 |
| Zinc Phthalocyanine sulfonate encapsulate | 0.027 |
| Suds suppressor | 2.80 |
| Layered silicate | 9.75 |
| Fluorescer | 0.115 |
| Sodium carbonate | 8.06 |
| Citric acid | 4.67 |
| Sodium percarbonate | 12.3 |
| Chelant particle | 0.494 |
| HEDP | 0.820 |
| Soil release polymer | 0.363 |
| Protease prill | 0.967 |
| Cellulase prill | 0.210 |
| Lipase prill | 0.350 |
| Amylase prill | 1.134 |
| Soap | 1.40 |
| Spray-ons | |
| Perfume Spray-on | 0.561 |
| Binder spray-on | 4.00 |
| TOTAL | 100% |

Anionic agglomerate A include 40% anionic surfactant, 29% Zeolite and 20% Sodium carbonate.

Anionic agglomerate B include 40% anionic surfactant, 27% Zeolite and 11% Sodium carbonate.

Nonionic agglomerate comprises 25% nonionic surfactant, 7% polyethoxylated hexamethylene diamine (quaternary salt), 36% anhydrous sodium acetate, 20% sodium carbonate and 12% Zeolite.

Cationic agglomerate include 20% cationic surfactant and 56% Zeolite.

Bleach activator agglomerate comprises 81% TAED, 17% acrylic/maleic copolymer and 2% water.

Zinc Phthalocyanine sulfonate encapsulates are 10% active.

Suds suppressor comprises 11.5% silicone oil and 88.5% starch.

Layered silicate comprises 95% SKS-6, 2.5% Sodium silicate-2.OR and 2.5% water.

Fluorescer contains Brightener 47 (70% active) and Brightener 49 (13% active).

Chelant particle contains ethylene diamine disuccinate and is 58% active.

The binder is polyethoxylated hexamethylene diamine (quaternary salt)

A series of tablets was made according to the following procedure:

45 g of this composition was introduced into a cylindrical tablet die with a diameter 54 mm, and compressed using a Lloyd Instruments LR50 testing apparatus at a rate of 10 mm/minute. The resulting tablet was removed from the mould and its diametral fracture stress (s) calculated using the following equation, where F is the force applied to cause fracture (in Newton), D is the tablet diameter (in m) and h is the tablet height (in m). A Vankel VK-200 tablet hardness tester was used to measure the fracture force. The compression load was optimised so as to produce a diametral fracture stress of 11(±1) kPa, calculated using the following equation:

$$s(\text{in Pa}) = \frac{2F}{pDh}$$

A series of similar 11 (±1) kPa tablets were prepared in this way for use in the following examples.

Tablet Coating

The composition of the net-coating polymer solutions are given in the following table (as percentage by weight of composition). The balance of the compositions to 100% is water.

| Polymer | I | II | III | IV | V |
|---|---|---|---|---|---|
| CMC | | | | 2 | |
| Opadry ®AMB | 26 | 40 | | 22 | 20 |
| Opadry ®II | | | 30 | | |
| PVP15 | | | | | 30 |
| PVP90 | 4.5 | | | | |

CMC is carboxymethyl cellulose
Opadry ®AMB is a polyvinyl alcohol based product available from Colorcon
Opadry ®II is a combination of polymers and polysaccharides product available from Colorcon
PVP15 is polyvinyl pyrrolidine polymer available from BASF
PVP90 is polyvinyl pyrrolidine polymer available from BASF The net coating is produced by spraying the coating compositions of examples I–V over the solid detergent tablet T. The coating compositions are sprayed onto the tablet from a distance between 10 to 15 cm under fast drying conditions. The highly viscous droplets exit the spray-nozzle and are lengthened to thin threads by the air-flow of the spray gun. The threads are pre-dried by hot air on their way from the nozzle to the tablet and deposit as slightly sticky fibres on the surface of the tablet. As the fibres are only partially dried, they stick together and form a net of cross-linked fibre with an average mesh size of about 10–100 $\mu$m. Thereafter, the net coating is finally dried using hot air.

The tablets produced have excellent dissolution and mechanical characteristics.

What is claimed is:

1. A coated solid body comprising a core of an active composition and having a water-soluble or dispersible micro-porous fibre network coating.

2. A coated solid body according to claim 1 wherein the micro-porous coating is in the form of a fibre network having an average mesh size in the range from about 10 $\mu$m to about 100 $\mu$m.

3. A coated solid body according to claim 1 wherein the coating comprises a water-soluble or dispersible polymer selected from polyvinyl alcohols, polyvinylpyrrolidones, polyvinyl acetates and partially hydrolysed polyvinyl acetates, polyvinyl amides, biopolymers and biopolymeric polyelectrolytes including carrageenans, pectins, gelatin, xanthan, alginates, agar, starch, latex, polymers derived from cellulose such as microcrystalline cellulose, methyl cellulose, ethyl cellulose, hydroxypropyl cellulose, carboxymethyl cellulose and mixtures thereof.

4. A coated solid body according to claim 1 wherein the coating is formed from a polymer solution containing a polymer or mixture of polymers in a proportion of from about 15% to about 70%, more preferably from about 20% to about 60% and most preferably from about 25% to about 50% by weight thereof.

5. A coated solid body according to claim 4 wherein the polymer solution comprises from about 30% to about 85% of solvent selected from organic and aqueous solvents and mixture thereof.

6. A coated solid body according to claim 4 wherein the polymer solution is a non-Newtonian fluid whose behaviour can be described by the Herschel-Bulkley model: $\tau=\tau_y+K\gamma^n$ where $\tau$ is the shear stress (Pa), $\tau_y$ is the yield stress (Pa), K is the fluid consistency index (Pa $s^n$), n is the power law exponent and $\gamma$ is the shear rate ($s^{-1}$) and wherein K is from about 1.0 to about 50 and preferably from about 4 to about 30, n is from about 0.1 to about 1.0 and preferably from about 0.4 to about 0.9 and $\tau$ about 0 to about 1.0 and preferably from about 0 to about 0.8.

7. A coated solid body according to claim 4 wherein the polymer solution is characterised by a non-zero yield stress and a shear stress of at least 30 Pa at a shear rate of 10 $sec^{-1}$.

8. A coated solid body according to claim 1 wherein the core and/or the coating contains a disintegrant.

9. A coated solid body according to claim 8 wherein the disintegrant is selected from starch: natural, modified or pregelatinized starch, sodium starch gluconate; gums including agar gum, guar gum, locust bean gum, karaya gum, pectin gum, tragacanth gum; croscarmylose Sodium, crospovidone, cellulose, algenic acid and its salts including sodium alginate, silicon dioxide, clay, ion exchange resins, polymers containing cationic (e.g. quaternary ammonium) groups, amine-substituted polyacrylates, polymerised cationic amino acids such as poly-L-lysine, polyallylamine hydrochloride and mixtures thereof.

10. A coated solid body according to claim 1 wherein the coating has a thickness in the range from about 1 to about 500 $\mu$m, preferably from about 5 to about 200 $\mu$m and extends over at least about 40%, preferably at least about 70% and more preferably 100% of the surface of the core.

11. A coated solid body according to claim 1 wherein an auxiliary continuous coating optionally comprising a disintegrant is introduced between the core and the net coating or on top of the net coating.

12. A coated solid body according to claim 1 in the form of a single or multi-phase detergent tablet.

13. A detergent tablet according to claim 1 having a multi-phase core wherein the coating extends across one or more phases of the core so as to provide differential dissolution or release of the active components of the tablet.

14. A process for coating a solid body comprising the step of contacting the body with a solution of a polymer or mixture of polymers in the form of elongated, viscoplastic fibre-forming droplets.

15. A process according to claim 14 including the step of partially drying the fibre-forming droplets prior to contacting the body.

16. A process according to claim 14 wherein the fibre-forming droplets are formed by spraying the solution through one or more spray nozzles situated from about 10 to about 30 cm proximal distance from the surface of the solid body and wherein the fibre-forming droplets are partially dried prior to contacting the solid body in a current of hot air.

17. A process according to claim 14 wherein the polymer solution comprises a water-soluble or dispersible polymer selected from the group consisting of: polyvinyl alcohols, polyvinylpyrrolidones, polyvinyl acetates and partially hydrolysed polyvinyl acetates, polyvinyl amides, biopolymers and biopolymeric polyelectrolytes including carrageenans, petins, gelatin, xanthan, alginates, agar, starch, latex, polymers derived from cellulose such as microcrystalline cellulose, methyl cellulose, ethyl cellulose, hydroxypropyl cellulose, carboxymethyl cellulose and mixtures thereof.

18. A process according to claim 14 wherein the polymer solution is a non-Newtonian fluid whose behavior can be described by the Herschel-Bulkley model: $\tau=\tau_y+K\gamma^n$ where $\tau$ is the shear stress (Pa), $\tau_y$ is the yield stress (Pa), K is the fluid consistency index (Pa $s^n$), n is the power law exponent and $\gamma$ is the shear rate ($s^{-1}$) and wherein K is from about 1.0 to about 50 and preferably from about 4 to about 30, n is from about 0.1 to about 1.0 and preferably from about 0.4 to about 0.9 and $\tau$ about 0 to about 1.0 and preferably from about 0 to about 0.8.

19. A process according to claim 14 wherein the polymer solution is characterised by a non-zero yield stress and a shear stress of at least 30 Pa at a shear rate of 10 $sec^{-1}$.

* * * * *